United States Patent [19]

Nunley

[11] Patent Number: 5,040,620

[45] Date of Patent: Aug. 20, 1991

[54] METHODS AND APPARATUS FOR DRILLING SUBTERRANEAN WELLS

[76] Inventor: Dwight S. Nunley, 500 Oakwood Dr., Gretna, La. 70056

[21] Appl. No.: 595,550

[22] Filed: Oct. 11, 1990

[51] Int. Cl.[5] ..... E21B 17/22

[52] U.S. Cl. ..... 175/61; 175/65; 175/323; 138/118; 464/18

[58] Field of Search ..... 175/61, 65, 323, 325; 166/241; 138/118, 122, DIG. 11; 464/18

[56] References Cited

U.S. PATENT DOCUMENTS

| | | | |
|---|---|---|---|
| 140,357 | 7/1873 | Frisbee . | |
| 981,306 | 1/1911 | Pollock . | |
| 1,084,871 | 1/1914 | Tuck . | |
| 2,166,937 | 7/1939 | Bettis | 175/323 |
| 2,571,644 | 10/1951 | Zublin | 255/1.4 |
| 2,572,839 | 10/1951 | McClinton | 255/73 |
| 2,856,157 | 10/1958 | Chapin et al. | 255/69 |
| 2,999,552 | 1/1961 | Fox | 175/323 |
| 3,085,639 | 4/1963 | Fitch | 175/323 |
| 3,125,173 | 3/1964 | Fox | 175/323 |
| 3,156,106 | 11/1964 | Crane | 64/27 |
| 3,194,331 | 7/1964 | Arnold | 175/323 |
| 3,360,960 | 1/1968 | Massey | 64/1 |
| 3,554,307 | 1/1971 | Yount | 175/323 |
| 3,749,189 | 7/1973 | Boehm | 175/323 |
| 4,210,215 | 7/1980 | Peetz et al. | 175/323 |
| 4,365,678 | 12/1982 | Fitch | 175/323 |
| 4,460,202 | 7/1984 | Chance et al. | 285/333 |
| 4,811,800 | 3/1989 | Hill et al. | 175/323 |
| 4,854,399 | 8/1989 | Zijsling | 175/323 |
| 4,967,855 | 11/1990 | Moser | 175/323 |

FOREIGN PATENT DOCUMENTS

| | | | |
|---|---|---|---|
| 263594 | 10/1967 | Austria | 175/323 |

*Primary Examiner*—Bruce M. Kisliuk

*Attorney, Agent, or Firm*—Patricia A. Martone; Nicola A. Pisano

[57] ABSTRACT

A method and apparatus is provided for drilling high-angle, directional and horizontal subterranean wells for hydrocarbon extraction. A drillstring component having at least one helical undercut pumping chamber is described, which drillstring component is designed especially for increased flexibility in directional drilling applications. The undercut pumping chamber of the invention drillstring component is designed to improve volumetric efficiency in removing cuttings from the borehole, and to reduce the incidence of differential sticking or key-seating.

9 Claims, 5 Drawing Sheets

METHODS AND APPARATUS FOR DRILLING SUBTERRANEAN WELLS

BACKGROUND OF THE INVENTION

This invention relates to a method and apparatus for drilling boreholes in the course of geological exploration for, and exploitation of, hydrocarbons and their by-products. More particularly, the invention relates to directional and horizontal drilling. Conventional geological exploration techniques have involved drilling vertical holes ("straight-holes").

Recent advances in art of drilling include the use of multiple high-angle development wells and directional and horizontal drilling techniques. High-angle well techniques involve drilling a well into a discovered oilsand resetvoir with the drillstring inclined at a substantial angle from the vertical. Directional drilling involves drilling a first borehole leg, a transition zone and a second borehole leg inclined at a substantial angle from the first borehole leg, so as to interpenetrate and exploit multiple oil-bearing sands from a single bore. For example, in horizontal drilling, the first leg may be vertical, and the second leg may be substantially horizontal, with a transition zone therebetween. The transition zone at which the two legs of the borehole meet may range from a gradual curve to an abrupt bend. The severity of the transition zone is measured in either bend radius or angle of inclination per horizontal distance. Thus, a transition zone curving at 2-6°/100 ft (3000-1000 ft radius) is regarded as a "long radius" borehole, whereas a transition zone of 1.5-3°/ft (40-20 ft radius) is regarded as a "short radius" borehole. While these advances in drilling techniques have increased well output over conventional straight-hole drilling methods, they have engendered a host of practical difficulties and imposed increased mechanical duty on drillstring components.

The mechanical duty imposed on drillstring components—the assembly of drill pipes, joints, drill collars and bit—by the advanced drilling techniques includes increased material fatigue due to high-maqnitude stress reversals. A conventional drill collar, heavyweight drill pipe, or drill pipe consists of a high-grade steel tubular cylinder of standard length (10-30 ft depending upon the application), having a circular cross section and a concentric passageway at the center for pumping a slurry/lubricant, referred to in the trade as "drilling mud", to the drill bit.

When used in high angle drilling operations, the inclination of the drillstring creates gravitationally induced bending moments along the drillstring component spans. These bending force amplitudes are further increased by the inability of the drill collars to provide uniform tension on the drillstring when subjected to a gravitational force component which is not in-line with the drill collar longitudinal axis. Consequently, the flexure, or bending moments manifest themselves as stress gradients across the diameter of the drillstring, inducing a compressive stress component in the upper half of the drillstring component and a tensile stress component in the lower half of the drillstring component. Each rotation of the drillstring during drilling subjects the drillstring component material to a flexure reversal of the stress field, leading to substantially increased mechanical fatigue of the drillstring components relative to conventional straight-hole drilling techniques.

Of equal importance to the increased mechanical duty is the reduction in volumetric efficiency encountered in high-angle and horizontal wells, i.e., the efficiency with which cuttings are removed from the borehole. Drilling mud—a rheolitic slurry of fluid and buoyant suspension agent, e.g., bentonite—is pumped through a passageway in the drillstring to the bit, where it is injected at high velocity and pressure against the formation through jets located in the bit. The heavy consistency of the drilling mud captures the cuttings generated by the bit, while its buoyant character causes the cuttings to rise out of the path of the bit. Because the drill bit diameter exceeds that of the other drillstring components, the cutting-laden drilling mud rises to the surface in the annulus surrounding the drillstring. It has been observed that in high-angle wells, there is a tendency for the cuttings to settle toward the lower side of the bore, due to the influence of gravity, thereby reducing the efficiency of the drilling mud in cleaning the hole. The problem with solids settling out of the drilling mud is exacerbated as the well angle increases, becoming most critical for horizontal boreholes.

Reduction in volumetric efficiency attributable to reduced effectiveness of the drilling mud hole-cleaning ability in high-angle and horizontal wells impacts a number of parameters. Because the cuttings are not removed from the path of the drill bit quickly, drilling efficiency (the rate of penetration or ROP) is reduced, leading to increased drilling time and energy requirements to achieve a specified borehole depth. Additionally, energy is lost by grinding the cuttings remaining in the path of the drill bit. The effect increases the difficulty in removing the cuttings and decreases the useful life of the bit—a substantial consideration in costly diamond drilling bit applications. Moreover, frequent removals of the drillstring to replace worn bits is a time consuming and expensive process, increasing the risk of a blowout endangering personnel.

Yet another important problem encountered in drilling oil and gas wells is the phenomena of "differential sticking." Differential sticking occurs when the fluid in the drilling mud located in the drillstring-borehole annulus is absorbed unevenly around the periphery of the drillstring through the porous media of the borehole wall. This fluid loss induces a pressure differential across the drillstring diameter which causes the drillstring to be deflected against the borehole wall on the side experiencing the fluid loss, and can lead to halting engagement of the drillstring against the borehole wall. Once so engaged, the unbalanced fluid pressure acts to keep the drillstring in engagement with the borehole wall. The torque required to free the drillstring may exceed the capacity of the rotary table or the top drive used to drive the drillstring, or may exceed the yield strength of a drillstring component, leading to "twist-off" (torsion induced fracture). Differential sticking may result in the loss of the drill bit and a portion of the drillstring, thereby necessitating time consuming and extremely expensive procedures to recover the detached drillstring portion. In some cases, where the detached portion cannot be retrieved, the drill operator may have to abandon the borehole and begin anew.

A final phenomenon observed with conventional drillstrings is that of "key seating" at "doglegs" (borehole direction changes) and "kick-off points", i.e., locations at which the angle of attack of the drill bit and drillstring is altered as the inclination from the vertical is increased. The phenomena of key-seating arises when there is sufficient bend in the borehole path to cause a portion of the drillstring to come into contact with one side of the borehole wall. This contact, if not substantial enough to cause differential sticking, can result in the drillstring forming a groove approximately the diameter of the drillstring in the borehole wall. If viewed in cross-section perpendicular to the borehole longitudinal axis, the borehole and groove would resemble a keyhole, with a large lower portion and a narrower upper portion. When key-seating occurs, it may no longer be possible to withdraw the drillstring from the borehole, since the larger diameter elements of the drillstring assembly (drill collars, stabilizers, etc.) will be unable to pass through the narrow groove. The phenomena of key-seating is due in large part to the rigidity of conventional drillstring components, which are unable to provide enough flexure to accommodate borehole directional changes and changes in the angle of attack. As with differential sticking, key-seating can lead to twist-off, necessitating time consuming retrieval procedures or abandonment of the borehole.

The aforementioned problems have provided a fertile ground for invention, and a number of prior art drillstring component designs are directed toward resolving one or more of these problems. One solution adopted by a number of prior art drillstring components, including the present invention, is the use of a helical flat or groove around the periphery of the drillstring component. Prior art drillstring components using such a solution may be generally grouped into two categories, each characterized by a disadvantage that the present invention is designed to overcome.

A first category of prior art helical groove drillstring component employs screw-like threads or broad V-shaped notches. Fitch U.S. Pat. No. 3,085,639 discloses a drill collar having screw-like threads on its periphery for drilling straight boreholes, wherein the flights of the screw coact with the borehole as a screw conveyor in removing cuttings from the vicinity of the drill bit. Arnold U.S. Pat. No. 3,194,331 and Massey U.S. Pat. No. 3,360,960 disclose, respectively, drillstring components having a single and multistep V-shaped helical groove on the circumference designed to reduce differential sticking, increase drilling mud flow through the borehole-drillstring annulus, and to act as a broach to reduce key-seating.

In operation, the configuration of the helical groove in all three of these patents is such that the sharp edges of the grooves may strip the drilling mud lining the borehole wall (referred to as wallcake), leading to instability of the borehole wall and concomitant loss of fluid from the borehole. The drillstring component of the present invention is designed to leave intact the desired wallcake thickness, generally 3/32", while still providing superior performance by increasing drilling mud flow up the annulus, plus reducing differential sticking and key-seating.

A second category of helical groove drillstring component employs a spiral groove wherein the groove constitutes essentially a chord intersecting two points on the circumference of the drillstring component. Fox U.S. Pat. No. 2,999,552, Chance et al. U.S. Pat. No. 4,460,202, and Hill et al. U.S. Pat. No. 4,811,800 all disclose spiral groove drillstring components wherein the groove forms a chord on the component, when viewed in transverse section. The purpose of the groove is to reduce differential sticking, improve flow of drilling mud up the borehole-drillstring annulus and to increase the load on the drill bit in directional drilling applications. Hill et al. U.S. Pat. No. 4,811,800 discloses trading-off drillstring component service life in favor of increased drillstring flexibility by employing a relatively deep spiral chord-style groove. The drillstring component of the present invention is designed to provide the benefits attributed to these prior art chord-style spiral groove drillstring components, plus superior service life and flexibility in short radius directional drilling applications.

In view of the foregoing, it is an object of this invention to provide a drillstring component for drilling high angle and short radius directional and horizontal boreholes which experiences reduced mechanical fatigue duty relative to previously known drillstring components, and which is readily integrable with existing drilling systems, including downhole drilling mud-driven turbine style motors ("mudmotors").

It is a further object of this invention to provide a drillstring component for drilling high angle, directional and horizontal boreholes which improves volumetric and drilling efficiencies, reduces time and energy costs of drilling, and increases drill bit life relative to that achieved with previously known drillstring components.

It is another object of this invention to provide a drillstring component for drilling high angle, directional and horizontal boreholes which substantially reduces the incidence of differential sticking, thereby reducing the major costs associated with retrieval of detached drillstring portions or abandonment of a partially drilled well.

It is yet another object of this invention to provide a drillstring component for drilling high angle and horizontal boreholes which has adequate flexibility to reduce the costs and additional effort required by incidents of key-seating and possible twistoff of the lower portion of the drillstring.

It is still another object of this invention to utilize the rotary motion of the drillstring to induce a turbine-style pumping ("turbo-pumping") action of the cutting-laden drilling mud away from the drill bit and subterranean formation interface toward the drilling mud treatment equipment at the borehole entrance.

This invention includes method steps carried out in sequence for obtaining the desired borehole-cleaning capability when drilling high angle, directional and horizontal boreholes.

SUMMARY OF THE INVENTION

These and other objects of the invention are accomplished in accordance with the principles of the invention by incorporating one or more helical pumping chambers in communication with the exterior of the drillstring component. The present invention is described with reference to a drill collar or drill pipe of standard exterior diameter, standard length, standard threaded connecting ends and standard metallurgical composition. A drillstring component constructed in accordance with the principles of this invention has one or more helical pumping chambers, wherein the helix is opposite to the drill rotary direction. Since it is conventional for drillstrings to be operated with a clockwise or right-hand twist, the helical pumping chamber preferably has a left-hand or counterclockwise helix relative to its longitudinal axis. The introduction of left-hand helical pumping chambers on a drillstring component adds both a turbo-pumping ability and increased flexibility to the drillstring component.

The pumping chambers, when viewed in transverse section, undercut the drillstring cylindrical surface, thereby creating an overhanging lip. The undercut pumping chambers in the exterior surface of the drillstring component are characterized by continuous, uniform, curves. Such curves, when viewed in axial cross-section, may be tear-shaped or pear-shaped.

In a preferred embodiment, the undercut defines a volute. The volute pumping chamber embodiment features a cross-section having at least two different radii of curvature, and has no sharp edges which could result in stress concentrations or which could strip the borehole wallcake.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
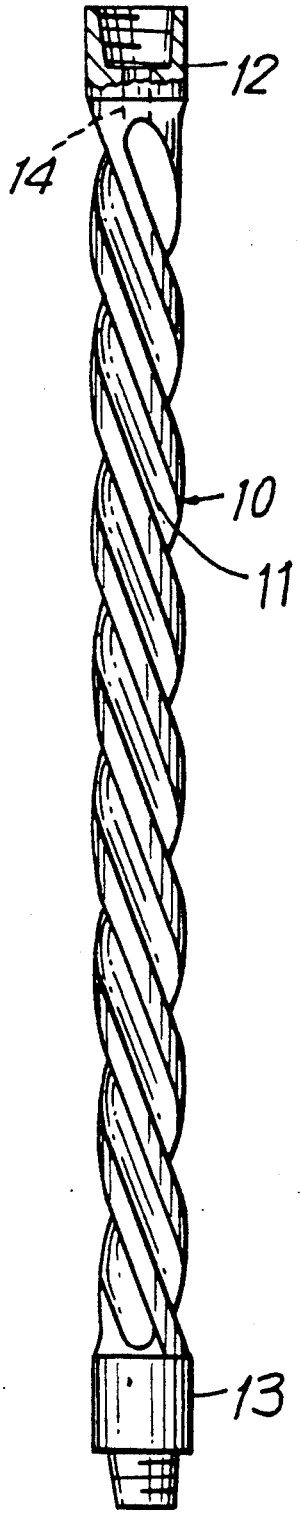
FIG. 1 is an elevation view of a drillstring component constructed in accordance with the principles of this invention.

FIG. 1 shows drillstring component 10 constructed in accordance with the principles of this invention. The drillstring component is illustrated here as a drill pipe, but it is to be understood that the present invention could be practiced on other components of a conventional drillstring, e.g., a drill collar or heavyweight drill pipe. Drillstring component 10 has a left-handed helical pumping chamber 11. Standard American Petroleum Institute ("A.P.I.") box tool joint 12 and pin tool joint 13 are attached, respectively, to the upper end and lower ends of drillstring component 10. A circular passageway 14 is concentrically located within drillstring component 10 for carrying drilling mud to the drillstring bit. Drilling mud is pumped downward through this passage by a drilling mud pump located near the entrance to the borehole, as described heretofore.

Figure 2:
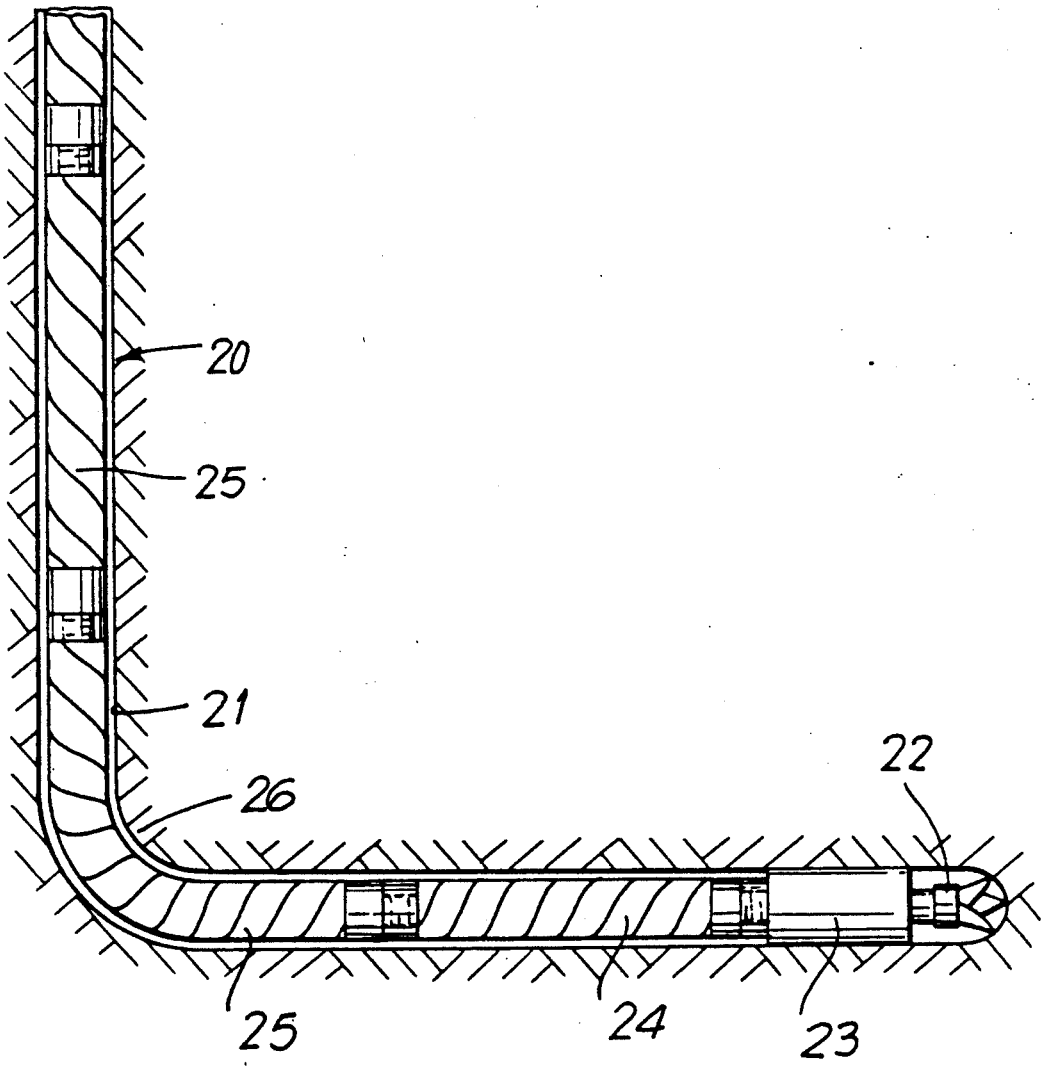
FIG. 2 is an elevation view of a drillstring, constructed in accordance with the principles of this invention, disposed within a directionally drilled borehole.

Referring now to FIG. 2, an elevation view of an illustrative embodiment of a drillstring 20, practicing the principles of the present invention, is disposed in a directionally drilled borehole 21. As shown in FIG. 2, borehole 21 comprise a vertical leg leading from the borehole entrance (not shown), a transition zone, a substantially horizontal leg and an annular passage defined by the borehole wall and the exterior of the drillstring. Drillstring 20 is comprised of drill bit 22, downhole mudmotor 23, drill collar 24 and drill pipe 25. The drillstring may in addition employ stabilizer units, not shown. Full length drillstring components 25 are joined by mating their respective threaded box and pin tool joints. The drillstring is engaged by a rotary table near the entrance of the borehole in a manner per se known. Drill bit 22, downhole mudmotor 23 and the assorted joint sections and stabilizer units are conventional devices and form no part of this invention. Rather, the invention resides in the addition of the uniquely designed helical pumping chamber 11 to the otherwise conventional drillstring components 24, 25 which chamber is cascaded upwards at each end of drillstring component 25 near the tool joint connection. A single helical groove is illustrated in FIG. 2, but it is to be understood that any number of grooves can be used to accomplish the turbo-pumping objectives of the invention. Five or more chambers spaced apart in equal relation around the periphery of drillstring component 25 are expected to provide the optimum cross-section for flexibility and fatigue resistance.

Drillstring components practicing the present invention may be formed by conventional machining techniques from high strength steel meeting A.P.I. metallurgy specification RPG 7.0. A pony collar—the short length drill collar used adjacent to the drill bit—may instead be formed from a Monel alloy when anti-magnetic properties are desired, for example, in measure-while-drilling applications. Drillstring components 24, 25 are of standard size (e.g., $7\frac{3}{4}''$ diameter for an $8\frac{3}{4}''$ borehole) and length for a given application and employ conventional box and pin tool joints.

FIG. 2 illustrates the flexion of drillstring component 25 at borehole kick-off point 26. It is contemplated that the helical pumping chamber will enhance the flexibility of drillstring component 25, permitting it to accommodate shorter radius directional changes with reduced mechanical fatigue. The added flexibility of drillstring component 25 also will reduce the extent of contact between drillstring 20 and borehole wall at kick-off point 26, thereby minimizing the possibility of key-seating.

Figure 3:
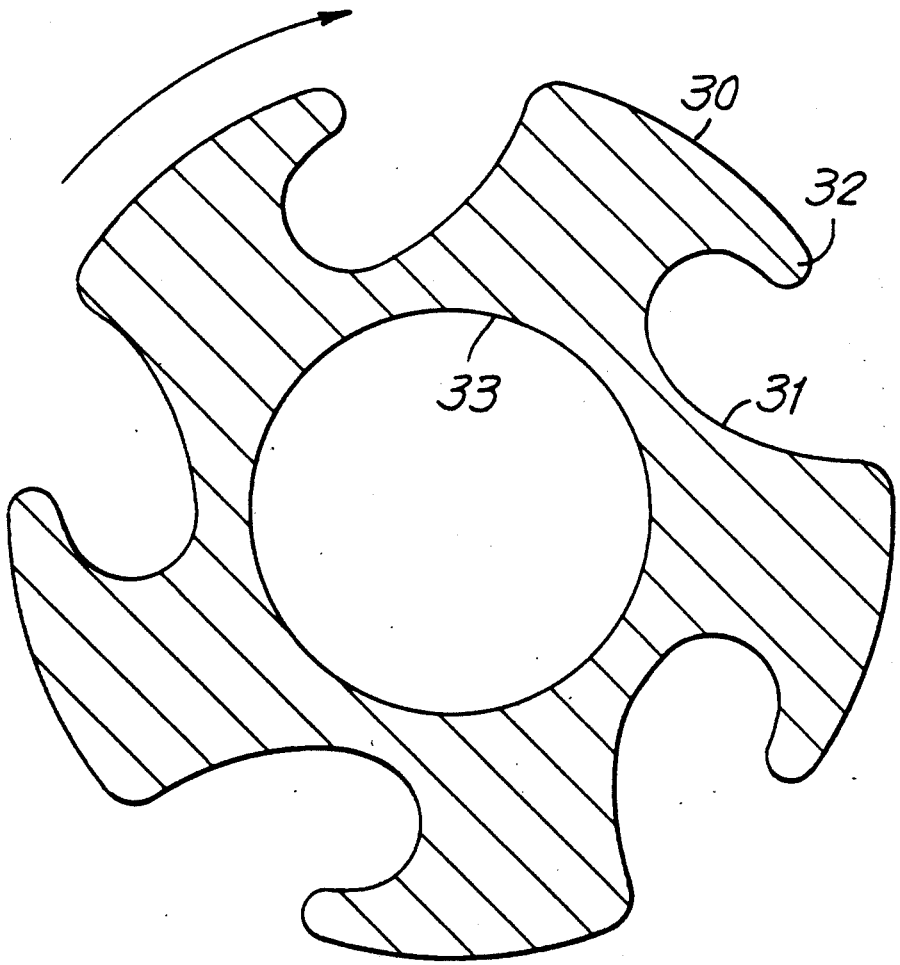
FIGS. 3–5 illustrate axial cross-sectional views of several preferred embodiments of a drillstring component constructed in accordance with the principles of this invention.
Figure 4:
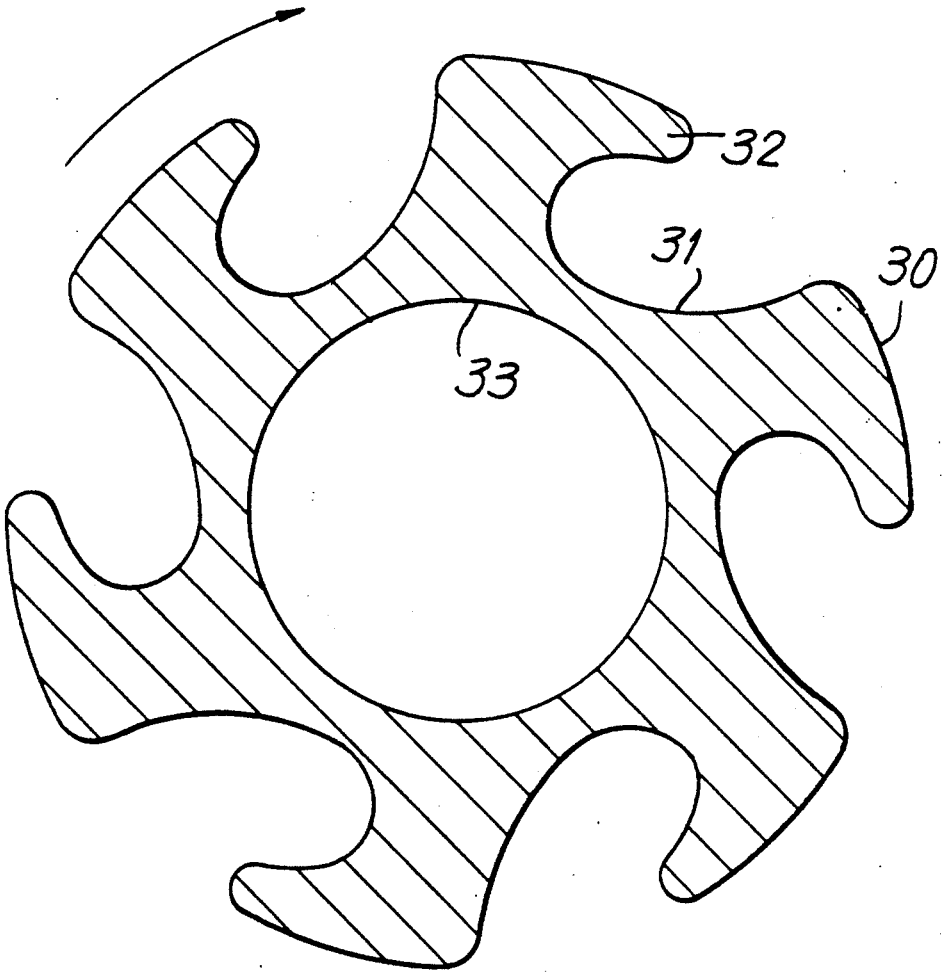
Figure 5:
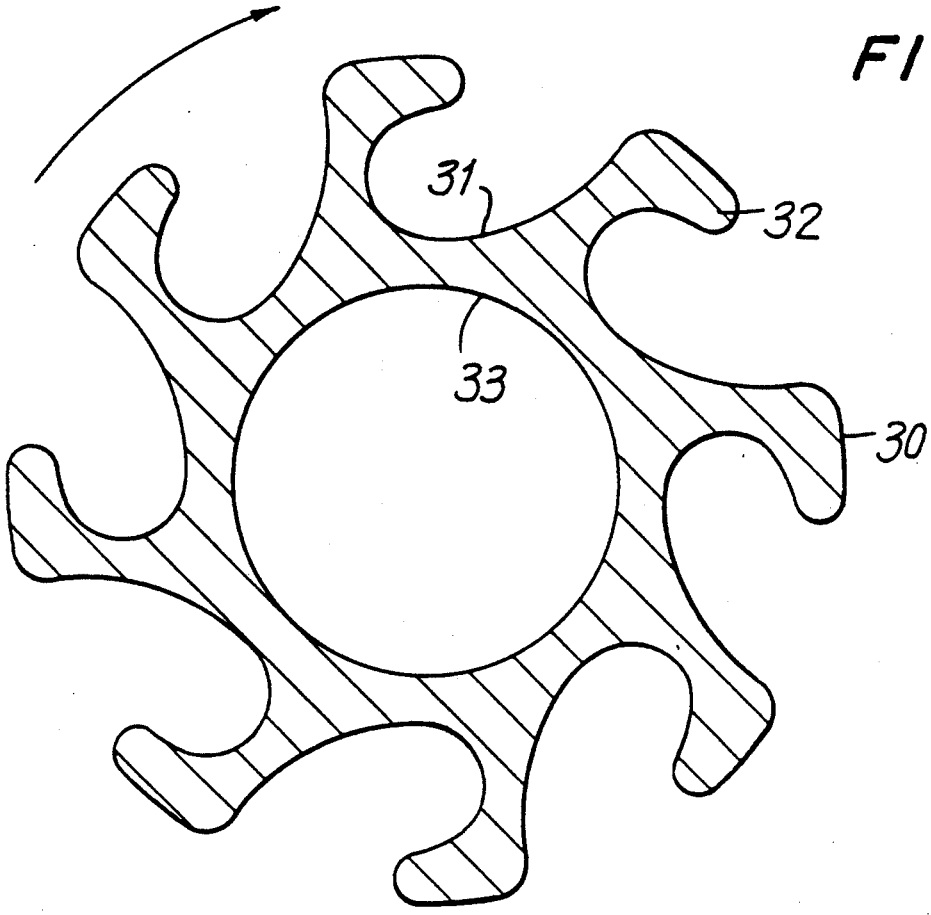

FIGS. 3, 4 and 5 show a number of drillstring component axial cross-sectional plan views illustrating the uniquely designed pumping chamber constructed in accordance with the present invention. FIG. 3 provides an axial cross-sectional view of drillstring component 30 having five pear-shaped or finger-like continuously curving undercut pumping chambers 31. The pumping chambers are undercut with respect to the cylindrical surface of the drillstring component, thereby forming a lip 32 associated with each pumping chamber. In the preferred embodiment shown in FIGS. 3–6, the pumping chamber forms a volute having at least two portions of different radii of curvature. FIG. 4 shows six volute pumping chambers in a drillstring component cross-section, while FIG. 5 shows eight volute pumping chambers in a drillstring component cross-section.

Each of the drillstring component cross-sections in FIGS. 3–5 has a central bore 33 through which the drilling mud is pumped to drill bit 22. The direction of twist of pumping chambers 31, indicated by the arrow in FIGS. 3–5, is counterclockwise when viewed in axial elevation (i.e., a left-hand twist, see FIG. 1), based on the convention that the drill is rotated in a clockwise direction. The surface of pumping chamber 31, when viewed in axial cross section, may define a tear-shape, or pear-shape having a continuously curved perimeter so as to minimize the creation of stress concentration points that might otherwise result in fracture of lip 32 or destruction of the wallcake lining the borehole. The pumping chamber is characterized by having an undercut portion with respect to the surface of the drillstring component, so that lip 32 is formed to overhang the pumping chamber, as shown in FIG. 6.

In the preferred embodiment configuration, the pumping chamber, when viewed in axial cross-section, defines a continuously curved volute having at least two portions with different radii of curvature. Referring again to FIG. 6, pumping chamber 31 is comprised substantially of two portions having radii of curvature "c" and "d". The precise configuration of the pumping chamber axial cross-section is not critical, provided that the radius of curvature of portion "d" of the volute is substantially smaller than that for portion "c". In one preferred embodiment, the ratio of radii c to d is 3.25:1.

Figure 6:
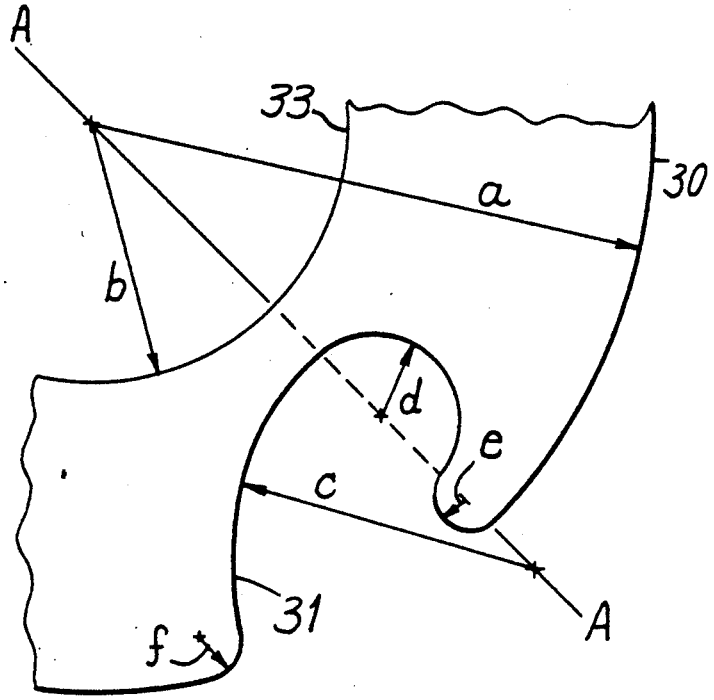
FIG. 6 is a fragmentary view of a drillstring cross-section embodying the present invention, illustrating the volute pumping chamber dimensions.

In an alternate embodiment, the shape of the volute is a mirror image across the radius A—A shown in FIG. 6. This embodiment of the helical volute pumping chamber is contemplated to have the advantage of increasing turbidity in the drilling mud present in the borehole-drillstring annulus, while having lower pumping capacity. Creating turbidity in the drilling mud located in the borehole-drillstring annulus can have important advantages as described hereinafter.

The helical pitch of the pumping chambers 31 (i.e., the distance between portions of the same groove measured on a line parallel to the drillstring component longitudinal axis) will vary depending upon the number of pumping chambers employed and the volume of the pumping chambers. It is contemplated that the pitch of the spiral should not be less than that necessary to encircle the circumference of the drillstring component over a length equal to 12 times the outer diameter of the drillstring component, and not more than that necessary to encircle same over a length 3 times such diameter. However, the velocity in the drillstring longitudinal direction of any point on the interior of the pumping chamber must exceed that of the velocity of the drilling mud in the adjacent borehole-drillstring annulus, within the range of drillstring rotation speeds.

It is also contemplated that the cross-sectional area of the pumping chambers 31 may equal from 5 percent to 60 percent of the cross-sectional area of a smooth surface drillstring component of the same inner and outer diameters. The minimum cross-sectional area within each pumping chamber must be such that a cutting of the maximum size likely to be encountered in drilling a given subterranean formation will pass cleanly through the pumping chamber, i.e., without becoming stuck in the pumping chamber.

The pumping chamber in drillstring component 31 provides a number of advantages over prior art spiral groove drillstring components and conventional circular cylinder drill collars when used in high-angle, directional and horizontal drilling applications. The helical volute pumping chamber acts partly in a manner analogous to an Archimedean screw by propelling the cutting-laden drilling mud generated at the drill bit backwards and upwards toward the top of the borehole. Furthermore, as the drilling mud is propelled upward by the pumping chamber it induces a dynamic flow field in the annulus. Rotation of the drillstring component creates a partial suction at the bottom of the borehole tending to draw up additional amounts of drilling mud due to the localized underbalanced condition at the drill bit/formation interface, thus increasing the rate of penetration.

In conventional drilling applications, only about one-half of the borehole depth is attributable to the mechanical cutting energy of the drill bit; the balance of the earth cutting power is supplied by the hydrodynamic impact forces created by injecting the drilling mud through the drill bit jets. Drillstring component 25 harnesses the rotational energy of drillstring 20, which would otherwise be lost, for example, as heat, and uses that energy to increase the volumetric efficiency of the drilling rig. The turbo-pumping action induced by spiral pumping chamber 11 enhances cuttings removal and provides a clear path for the drill bit to contact uncut formation, rather than pulverizing previous cuttings which heretofore were not quickly removed from the drill bit path. Consequently, significant increases in the rate of penetration of the drill bit and a concomitant increase in drill bit life may be realized.

Referring again to FIG. 1, pumping chamber 11 of drillstring component 10 significantly reduces the incidence of differential sticking because pumping chamber 11 acts to equalize fluid pressure around the periphery of the drillstring component. Also, since the drilling mud is free to flow through pumping chamber 11 to equalize any gradients around the drillstring component periphery, there is no longer a problem of lateral fluid pressure imbalance maintaining the drillstring component in halting engagement with the borehole wall. Finally, since drillstring components constructed in accordance with the principles of the present invention are not subject to drag induced by lesser degrees of differential sticking (i.e., downhole torque reduction), the drillstring can achieve higher rotary speeds with less concern about twistoff.

Finally, the configuration of pumping chamber 11 is designed to permit increased flexion of the drillstring component relative to previously known devices. Whereas, for example, a drillstring component designed in accordance with Hill et al. U.S. Pat. No. 4,811,800, based on the data contained in FIG. 10 of that patent, would experience twistoff within six hours (assuming a conservatively low rotary speed of 35 r.p.m. and a bend radius of 50 feet), it is contemplated that a drillstring component constructed in accordance with the present invention, and having five or more helical pumping chambers, would have a service life of several hundred hours.

It is to be understood that the number of spiral pumping chambers 11 employed at equally spaced locations around the circumference of the drillstring component may vary from one to many, and that precise configuration of the pumping chambers is not critical, provided that the pumping chambers preferably have a twist oriented in the direction opposite that of the drillstring rotation. Furthermore, the range of cross-sectional area of the drillstring component that can be dedicated to the pumping chamber is limited at the lower end only by the minimum needed to induce a pumping action (dependent in part also upon the helical pitch) and at the upper limit by the minimum amount of metal required to maintain the torsional strength of the drillstring component.

EXAMPLE 1

For the volute pumping chamber shown in FIG. 6, wherein the dimensions a–f are: a=3.25"; b=1.50"; c=0.5"; e=0.19" and f=0.25", the cross-sectional area of the pumping chamber is about 2.0 $in^2$.

Calculated values of the pumping capacity for a 30 foot long drillstring component embodying the present invention, with the foregoing pumping chamber dimensions, and having a pitch of 1/10 turns per foot, are presented in Table 1 as a function of the number of volutes present on the drillstring component periphery.

TABLE 1

| Number of Volutes | % Reduction in Area* | Pumping Capacity GPM @ RPM | | |
|---|---|---|---|---|
| | | 10 RPM | 25 RPM | 50 RPM |
| 1 | 7.6 | 5.5 | 13.8 | 27.6 |
| 3 | 22.9 | 16.5 | 41.4 | 82.8 |
| 5 | 38.3 | 27.5 | 69.0 | 138.0 |
| 6 | 46.0 | 33.0 | 82.8 | 165.6 |
| 8 | 61.3 | 44.0 | 110.4 | 221.8 |

*Reduction in Area computed relative to a smooth circular cylinder with outer radius of 3.25" and inner radius of 1.5".

While the prior art helically grooved drillstring components emphasize that the grooves serve to increase the load on the drill bit when used in directional and horizontal drilling applications, the counter-rotation twist of the drillstring of the present invention is particularly suitable for use with downhole mudmotors, since operation of the invention drillstring component will not induce any "screw down" or other forces which might cause the mudmotor or bit to deviate from its intended path. Since the function of the mudmotor and assembly is to maintain a true course for the interpenetration of oilsand zones, extraneous forces introduced by the prior art drillstring components may be undesirable. In fact, such "screwing down" action may result in aggressive contact between these other prior art devices and the borehole wall, thereby destroying the wallcake and impeding progress.

Finally, the pumping capacity of the present invention, as represented in Table 1, gives a drillstring component embodying the present invention the additional advantage of borehole cleaning in the event of a drilling mud pump shutdown or failure. With presently existing drillstring components, drilling mud pump shutdown can result in cuttings quickly settling out of suspension and packing in against the drillstring stabilizers, drill collars and bit, thereby impeding or preventing withdrawal of the drillstring. However, simply rotating a drillstring embodying pumping chambers of the present invention—using the rotary table or top drive—will keep the cuttings in suspension and pump cutting-laden drilling mud to the surface. Thus, a drillstring embodying the present invention features greatly enhanced retrievability, even in the event of drilling mud pump shutdown or failure.

What is claimed is:

1. A drillstring component for use in a drillstring carrying a drill bit, said drillstring rotatably driven in a working direction, said drillstring component comprising:

a. an elongated cylindrical body having two ends, a concentrically disposed axial passageway for carrying drilling mud to said drill bit, and an exterior surface defining at least one helical pumping chamber having a twist, when viewed in axial elevation, opposite to that in which said drillstring is rotatably driven in said working direction, said pumping chamber, when viewed in transverse section, having an undercut portion relative to the surface of the drillstring component, said undercut portion defining a lip; and b. a threaded connection at each one of said two ends of said elongated cylindrical body for assembling said elongated cylindrical body into said drillstring.

2. The drillstring component of claim 1 wherein said pumping chamber having an undercut portion defines a tear-shape or pear-shape with a continuously curved perimeter.

3. The drillstring component of claim 2 wherein said pumping chamber defines a volute having at least two portions with different radii of curvature.

4. The drillstring component of claim 1 including a plurality of said helical pumping chambers wherein said pumping chambers are in substantially equally spaced apart relation about the periphery of said drillstring component.

5. The drillstring component of claim 1 wherein said helical pumping chamber cascades to said exterior surface of said drillstring component in a smooth transition at each one of said ends of said drillstring component.

6. The drillstring component of claim 3 wherein said two portions of said continuously curved volute have radii of curvature with a ratio of 3.25:1.

7. In a method of drilling a borehole into the earth for the exploration and extraction of hydrocarbons and their by-products, the steps comprising:

a. drivingly rotating a bit carried on a drillstring into the earth to create cuttings, a first borehole leg having an entrance and a first annular passage between said drillstring and said first borehole leg;

b. injecting drilling mud into said first borehole leg through said drillstring and said bit, so that said drilling mud captures said cuttings and achieves an upward velocity through said first annular passage towards said entrance;

c. providing a helical passage disposed in said first borehole leg, said helical passage defining, in transverse section, an undercut portion and a lip; and d. rotating said helical passage in a direction opposite that of the rotation of said drillstring so as to impart a velocity to any point on said helical passage that is at least as great as said upwards velocity achieved by said drilling mud towards said entrance, whereby said drilling mud and said cuttings are impelled upwards through said first annular passage.

8. The method of claim 7 further comprising the steps of:

a. selectively flexing said drillstring below said first borehole leg while drivingly rotating said drillstring into the earth to create further cuttings, a second borehole leg inclined at an angle from said first borehole leg, a transition zone between said first and second borehole legs, and a second annular passage between said second borehole leg and said transition zone and said drillstring disposed therein, said second annular passage communicating with said first annular passage;

b. injecting drilling mud into said second borehole leg through said drillstring and said bit, so that said drilling mud captures said further cuttings and achieves a velocity within said second annular passage towards said entrance;

c. providing said helical passage disposed within said second borehole leg and transition zone; and d. rotating said helical passage in said direction opposite to the rotation of said drillstring so as to impart a velocity to any point on said helical passage disposed in said second borehole leg or transition zone that is at least as great as said velocity achieved by said drilling mud within said second annular passage towards said entrance, whereby said drilling mud and said further cuttings are impelled upwards out of said second annular passage.

9. In a method of drilling a directional borehole into the earth for the exploration and extraction of hydrocarbons and their by-products, the steps comprising:

a. rotatingly driving a bit carried on a drillstring into the earth to create cuttings, a borehole having at least a first leg, a second leg inclined at an angle from said first leg, and a transition zone therebetween, an entrance to said borehole, and an annular passage between said drillstring and said borehole;

b. injecting drilling mud into said borehole through said drillstring and said bit, so that said drilling mud captures said cuttings and achieves a velocity within said annular passage towards said entrance;

c. providing a helical passage disposed in said borehole, said helical passage defining, in transverse section, an undercut portion and a lip; and d. rotatingly driving said helical passage in a direction opposite that of the rotation of said drillstring so as to impart a velocity to any point on said helical passage that is at least as great as said velocity of said drilling mud within said annular passage towards said entrance, whereby said drilling mud and said cuttings are impelled through said annular passage towards said entrance of said borehole.

* * * * *